US006114923A

United States Patent [19]

Mizutani

[11] Patent Number: 6,114,923

[45] Date of Patent: Sep. 5, 2000

[54] SWITCHING CIRCUIT AND SEMICONDUCTOR DEVICE

[75] Inventor: Hiroshi Mizutani, Tokyo, Japan

[73] Assignee: NEC Corporation, Tokyo, Japan

[21] Appl. No.: 09/144,068

[22] Filed: Aug. 31, 1998

[30] Foreign Application Priority Data

Sep. 1, 1997 [JP] Japan ..... 9-236129

[51] Int. Cl.[7] ..... H01P 1/15

[52] U.S. Cl. ..... 333/103; 333/104; 333/262; 327/408; 327/416; 327/427; 327/436

[58] Field of Search ..... 333/103, 104, 333/262; 327/409, 408, 416, 427, 436

[56] References Cited

U.S. PATENT DOCUMENTS

| | | | |
|---|---|---|---|
| 4,733,203 | 3/1988 | Ayasli | 333/103 X |
| 4,841,169 | 6/1989 | Tsironis | 333/104 X |
| 5,012,123 | 4/1991 | Ayasli et al. | 333/262 |
| 5,517,150 | 5/1996 | Okumura | 327/427 |
| 5,696,470 | 12/1997 | Gupta et al. | 333/103 |

OTHER PUBLICATIONS

Iyama, et al.; "Inductor Merged FET Switch"; Technical Report of IEICE; Jul., 1996; pp. 21–26.

*Primary Examiner*—Paul Gensler

*Attorney, Agent, or Firm*—McGinn & Gibb, P.C.

[57] ABSTRACT

Disclosed is a switching circuit which has: at least one unit circuit connected in series, the unit circuit being composed of two field-effect transistors connected in series and an inductor that has one end connected to a connection point between the two field-effect transistors and another end grounded; wherein the gates of the two field-effect transistors are commonly connected and a bias voltage to control the turning on/off of the two field-effect transistors is equally applied through a resistance to the respective gates. Also disclosed is a semiconductor device which has: at least one unit element connected in series, the unit element being composed of two field-effect transistors connected in series each of which has a source electrode and a drain electrode disposed sandwiching a gate electrode, one of the source electrode and the drain electrode being used as a common electrode, and a via hole disposed on a semiconductor substrate to connect the common electrode with a ground potential, the via hole operating as an inductor: and a resistance disposed on a gate bias line to apply a bias voltage to control the turning on/off of the two field-effect transistors equally to a plurality of the gate electrodes; wherein the plurality of the gate electrodes are commonly connected.

15 Claims, 23 Drawing Sheets

SWITCHING CIRCUIT AND SEMICONDUCTOR DEVICE

FIELD OF THE INVENTION

This invention relates to a switching circuit and a semiconductor device including at least one field-effect transistor.

BACKGROUND OF THE INVENTION

As a promising switching circuit with a field-effect transistor (hereinafter referred to as 'FET') for extreme high frequency band, a semiconductor device in which an inductor is connected in parallel between the source and drain of FET is proposed (Iyama et al., "Inductor Built-in FET Switch", Technical Report of IEICE, Vol. MW-96-71, pp.21–26, July, 1996)

FIG. 1 is a circuit diagram showing a conventional switching circuit. In FIG. 1, an inductor 123 is connected in parallel between the source and drain of FET 121, and a switching is conducted between a first terminal 125 and a second terminal 126 when FET 121 is turned on/off. Though FET 121 is a three-terminal element, FET 121 can be equivalently represented as a two-terminal element because the bias line connected with the gate is opened in RF manner when a sufficient large resistance 124 is connected to the gate. Namely, FET 121 is equivalent to a capacitance C when it is turned off, and it is equivalent to a resistance R when it is turned on.

FIG. 2 is a circuit diagram showing the equivalent circuit that FET in FIG. 1 is turned off, and FIG. 3 is a circuit diagram showing the equivalent circuit that FET in FIG. 1 is turned on.

As shown in FIG. 2, when FET is turned off by applying a voltage lower than the pinch-off voltage, the circuit between the first terminal 125 and the second terminal 126 becomes equivalent to a circuit that the capacitance C and the inductor L are connected in parallel. In this case, isolation Is between the first terminal 125 and the second terminal 126 is given by:

$$Is = \frac{1}{1 + \left(\frac{\pi f L}{Z_0(1 - 4\pi^2 f^2 LC)}\right)^2} \quad [1]$$

Here, a resonance frequency $f_0$ for the parallel-connected capacitance C and inductor L is given by:

$$f_0 = \frac{1}{2\pi\sqrt{LC}} \quad [2]$$

When a signal with the resonance frequency $f_0$ input, electric power to be transmitted from the first terminal 125 to the second terminal 126 becomes zero. In this case, isolation Is becomes ideally infinite.

However, even when the frequency of a signal input to the first terminal 125 is slightly deviated from the resonance frequency, isolation Is is highly reduced. For example, in the conventional semiconductor device in FIG. 1, isolation Is is 10 dB at the resonance frequency $f_0$=37 GHz. But, when the frequency becomes 35 GHz, isolation Is is reduced to 7 dB.

On the other hand, when FET is turned on as shown in FIG. 3, the circuit between the first terminal 125 and the second terminal 126 becomes equivalent to a circuit that the resistance R and the inductor L are connected in parallel. In this case, electric power to be transmitted from the first terminal 125 to the second terminal 126 is given by;

$$S_{21} = \frac{2}{2 + \frac{R}{Z_0\left(1 + \frac{R}{2\pi j f L}\right)}} \quad [3]$$

where the impedances of the first terminal 125 and the second terminal 126 are $Z_0$. In this case, according as the frequency f is increased, insertion loss IL goes, from zero, near to:

$$IL = \left(\frac{2}{2 + \frac{R}{Z_0}}\right)^2 \quad [4]$$

The insertion loss of the conventional semiconductor device in FIG. 1 is 1.3 dB at 37 GHz.

Meanwhile, in the conventional switching circuit, the ideal values of insertion loss and isolation Is for. e.g., a signal of 94 GHz can be calculated using expressions [1] and [3]. FIG. 4 shows the calculation results. In FIG. 4, the resonance frequency $f_0$ is 92 GHz for L=100 pH and C=0.03 pF. A label "ON" in FIG. 4 indicates frequency characteristics of an ON (turn-on or closed) state of the switch. A label "OFF" indicates frequency characteristics of an OFF (turn-off or opened) state characteristics of the switch. Herein, a frequency range with isolation Is greater than 20 dB is defined as 'effective band'. Thus, the effective band of the switching circuit in FIG. 1 becomes 5.3 GHz.

Accordingly, in the conventional switching circuit, there is a problem that the effective band is thus narrow.

SUMMARY OF THE INVENTION

Accordingly, it is an object of the invention to provide a switching circuit and a semiconductor device that can have a wide effective band even for a 60 GHz or higher frequency while keeping a high performance of switching circuit.

According to the invention, a switching circuit, comprises:

at least one unit circuit connected in series, the unit circuit being composed of two field-effect transistors connected in series and an inductor that has one end connected to a connection point between the two field-effect transistors and another end grounded;

wherein the gates of the two field-effect transistors are commonly connected and a bias voltage to control the turning on/off of the two field-effect transistors is equally applied through a resistance to the respective gates.

According to another aspect of the invention, a switching circuit, comprises:

at least one unit circuit connected in series, the unit circuit being composed of a field-effect transistor, a first inductor that has one end connected to the source of the field-effect transistor and another end grounded, and a second inductor that has one end connected to the drain of the field-effect transistor and another end grounded;

wherein the gates of a plurality of the field-effect transistors are commonly connected and a bias voltage to control the turning on/off of the field-effect transistor is equally applied through a resistance to the respective gates.

According to another aspect of the invention, a switching circuit, comprises:

at least one unit circuit connected in series, the unit circuit being composed of a field-effect transistor, first and second transmission lines connected in series to the source of the field-effect transistor, the first and second transmission lines operating as inductors, third and fourth transmission lines connected in series to the drain of the field-effect transistor, the third and fourth transmission lines operating as inductors, a first inductor that has one end connected to a connection point between the first and second transmission lines and another end grounded, and a second inductor that has one end connected to a connection point between the third and fourth transmission lines and another end grounded;

wherein the gates of a plurality of the field-effect transistors are commonly connected and a bias voltage to control the turning on/off of the field-effect transistor is equally applied through a resistance to the respective gates, According to another aspect of the invention, a semiconductor device, comprises;

at least one unit element connected in series, the unit element being composed of two field-effect transistors connected in series each of which has a source electrode and a drain electrode disposed sandwiching a gate electrode, one of the source electrode and the drain electrode being used as a common electrode, and a via hole disposed on a semiconductor substrate to connect the common electrode with a ground potential, the via hole operating as an inductor; and a resistance disposed on a gate bias line to apply a bias voltage to control the turning on/off of the two field-effect transistors equally to a plurality of the gate electrodes;

wherein the plurality of the gate electrodes are commonly connected.

According to another aspect of the invention, a semiconductor device, comprises:

at least one unit element connected in series, the unit element being composed of a field-effect transistor which has a source electrode and a drain electrode are disposed sandwiching a gate electrode, one of the source electrode and the drain electrode being used as a common electrode, a first via hole disposed on a semiconductor substrate to connect the source electrode with a ground potential, and a second via hole disposed on the semiconductor substrate to connect the drain electrode with the ground potential, the first and second via hole operating as inductors; and a resistance disposed on a gate bias line to apply a bias voltage to control the turning on/off of the field-effect transistor equally to a plurality of the gate electrodes.

wherein the plurality of the gate electrodes are commonly connected.

According to another aspect of the invention, a semiconductor device, comprises:

at least one unit element connected in series, the unit element being composed of a field-effect transistor which has a source electrode provided with the function of first and second transmission lines to operate as inductors and a drain electrode provided with the function of third and fourth transmission lines to operate as inductors are disposed sandwiching a gate electrode, one of the source electrode and the drain electrode being used as a common electrode, a first via hole disposed on a semiconductor substrate to connect a connection point between the first and second transmission lines with a ground potential, and a second via hole disposed on the semiconductor substrate to connect a connection point between the third and fourth transmission lines with the ground potential, the first and second via hole operating as inductors; and a resistance disposed on a gate bias line to apply a bias voltage to control the turning on/off of the field-effect transistor equally to a plurality of the gate electrodes.

wherein the plurality of the gate electrodes are commonly connected.

BRIEF DESCRIPTION OF THE DRAWINGS

The invention will be explained in more detail in conjunction with the appended drawings, wherein.

DESCRIPTION OF THE PREFERRED EMBODIMENTS

Figure 1:
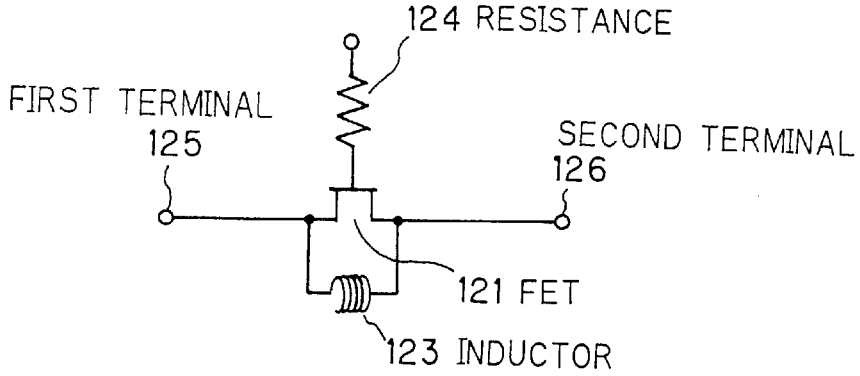
FIG. 1 PRIOR ART
FIG. 1 is a circuit diagram showing a conventional switching circuit.
Figure 2:
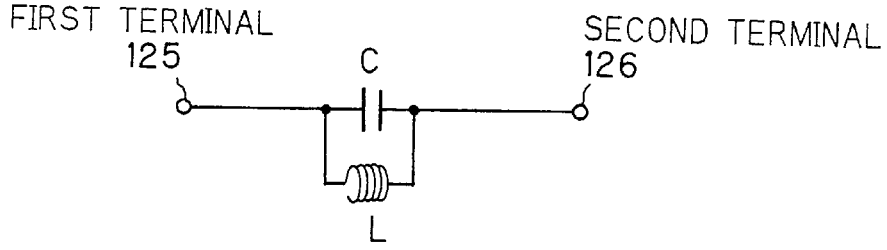
FIG. 2 PRIOR ART
FIG. 2 is a circuit diagram showing an equivalent circuit when FET is turned off in FIG. 1.
Figure 3:
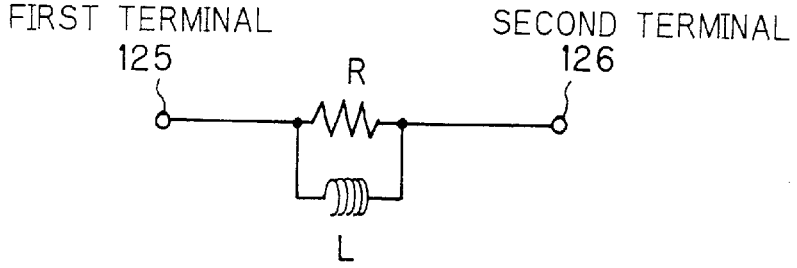
FIG. 3 PRIOR ART
FIG. 3 is a circuit diagram showing an equivalent circuit when FET is turned on in FIG. 1.
Figure 4:
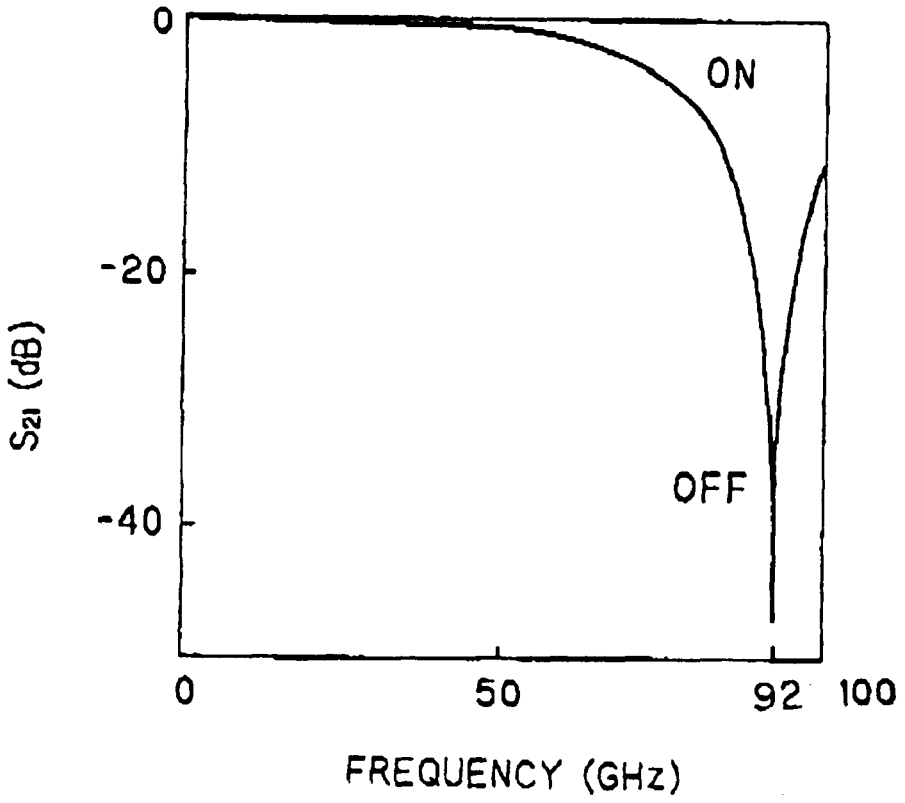
FIG. 4 PRIOR ART
FIG. 4 is a graph showing a frequency characteristic of the switching circuit in FIG. 1.
Figure 5:
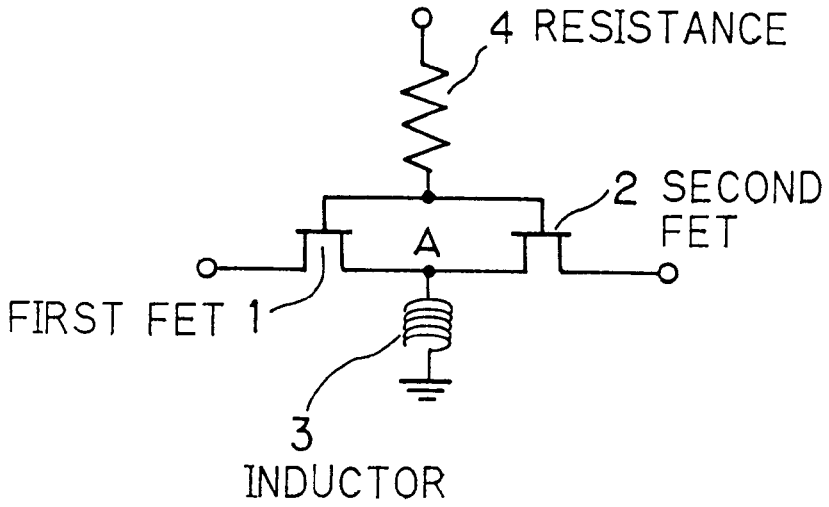
FIG. 5 is a circuit diagram showing the unit circuit of a switching circuit in a first preferred embodiment according to the invention.
Figure 6:
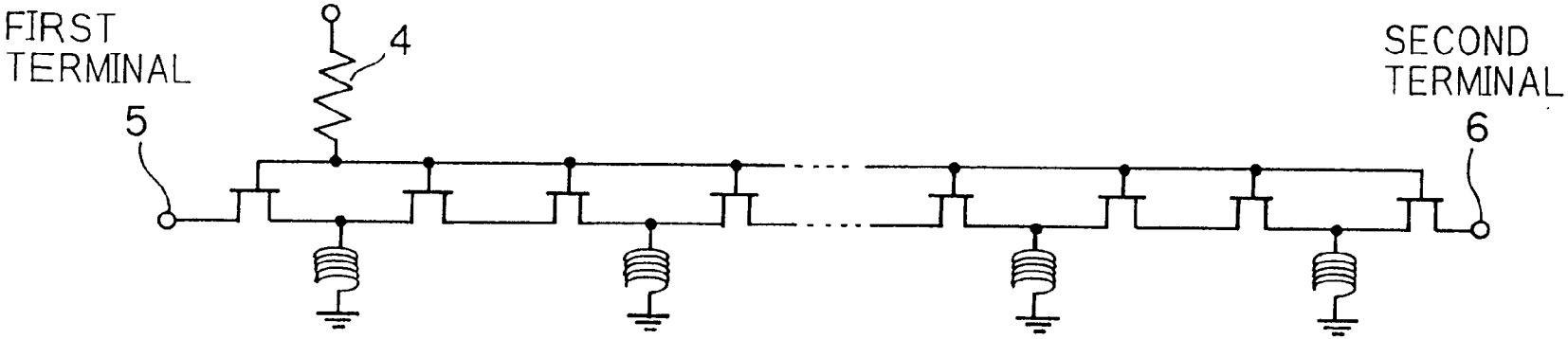
FIG. 6 is a circuit diagram showing the switching circuit in the first embodiment.
Figure 7:
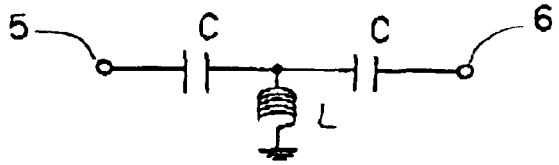
FIG. 7 is a circuit diagram showing an equivalent circuit when FET is turned off in FIG. 5.
Figure 8:
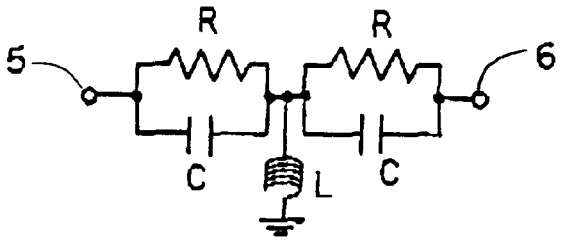
FIG. 8 is a circuit diagram showing an equivalent circuit when FET is turned on in FIG. 5.

A switching circuit in the first preferred embodiment will be explained in FIGS. 5 to 8. FIG. 5 is a circuit diagram showing a unit circuit as the component of the switching circuit in the first embodiment. FIG. 6 is a circuit diagram showing the whole composition of the switching circuit in the first embodiment. FIG. 7 is a circuit diagram showing an equivalent circuit when FET in FIG. 5 is turned off. FIG. 8 is a circuit diagram showing an equivalent circuit when FET in FIG. 5 is turned on.

In FIG. 5, the unit circuit is composed of a first FET 1, a second FET 2 and an inductor 3. The drain or source of the first FET 1 is connected with the source or drain of the second FET 2, and the first FET 1 and second FET 2 are connected in series. One end of inductor 3 is connected to a connection point A between the first FET 1 and the second FET 2, and another end of the inductor 3 is grounded. Also, the gates of the first FET land the second FET 2 are commonly connected, and a resistance 4 is connected thereto.

As shown in FIG. 6, the switching circuit in the first embodiment is composed of several unit circuits as shown in FIG. 5 to be connected in series. The gates of FETs as components of the respective unit circuits are commonly connected, and a bias voltage is equally applied through the resistance 4 to them. Also, both ends of the switching circuit are connected with a first terminal 5 and a second terminal 6.

In this composition, when FETs are turned Off, each of the unit circuits is equivalent to a T-type high-pass filter having two equivalent capacitors C and an equivalent inductor I as shown in FIG. 7. Therefore, an ON-state with low insertion loss and a wide band characteristic can be realized between the first terminal 5 and the second terminal 6, i.e., in the switching circuit.

On the other hand, when FETs are turned on, each of the unit circuits is equivalent to a-circuit as shown in FIG. 8 having a parallel resistance R and capacitor C coupled to a parallel resistor R and capacitor C. An equivalent inductor L is provided at the common node of the two parallel equivalent circuits. Therefore, due to the resistance of several FETs connected in series, an OFF-state with high isolation and a wide band characteristic can be realized between the first terminal 5 and the second terminal 6, i.e., in the switching circuit.

However, when sufficient isolation can be obtained by one unit circuit (e.g., in case of a sufficient large resistance value), it is not necessary to use several unit circuits. Even in this case, low insertion loss and a wide band characteristic can be obtained since it forms a T-type high-pass filter in turning on the switch. Meanwhile, in designing, a frequency characteristic between the first terminal 5 and the second terminal 6 can be determined by a capacitance of FET and an inductor value.

Figure 9:
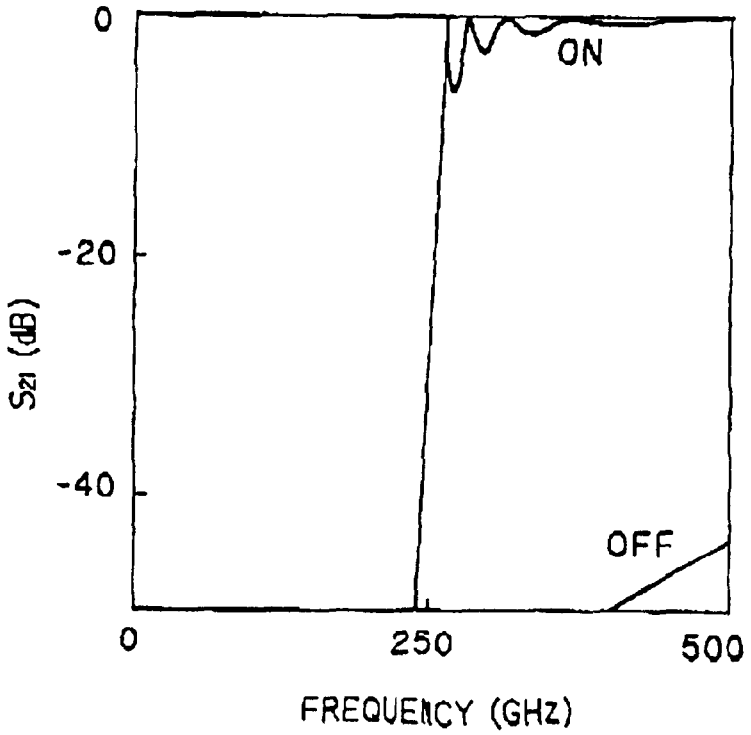
FIG. 9 is a graph showing a frequency characteristic of a semiconductor device in a first preferred embodiment according to the invention.

Referring to FIG. 9, a semiconductor device to form the switching circuit in the first embodiment will be explained below.

The semiconductor device in the first embodiment is, based upon the switching circuit in FIG. 5, composed of eight FETs connected in series, each of which is a AlGaAs system hetero-junction FET with a gate length of 0.15 $\mu$m and a gate width of 100 $\mu$m. Also, in turning off FETs, the capacitance is 30 pF and the inductance is 13 pH. The switching characteristic is shown in FIG. 9. A label "ON" in FIG. 9 indicates frequency characteristics of an ON (turn-on or closed) state of the switch. A label "OFF" indicates frequency characteristics of an OFF (turn-off or opened) state characteristics of the switch.

FIG. 9 shows a frequency characteristic of the semiconductor device in the first embodiment. As shown in FIG. 9, in this embodiment, a characteristic with insertion loss lower than 2.3 dB and isolation higher than 44 dB can be obtained in a wide frequency range of 300 GHz to 500 GHz. Also, the effective band is 200 GHz.

Figure 10:
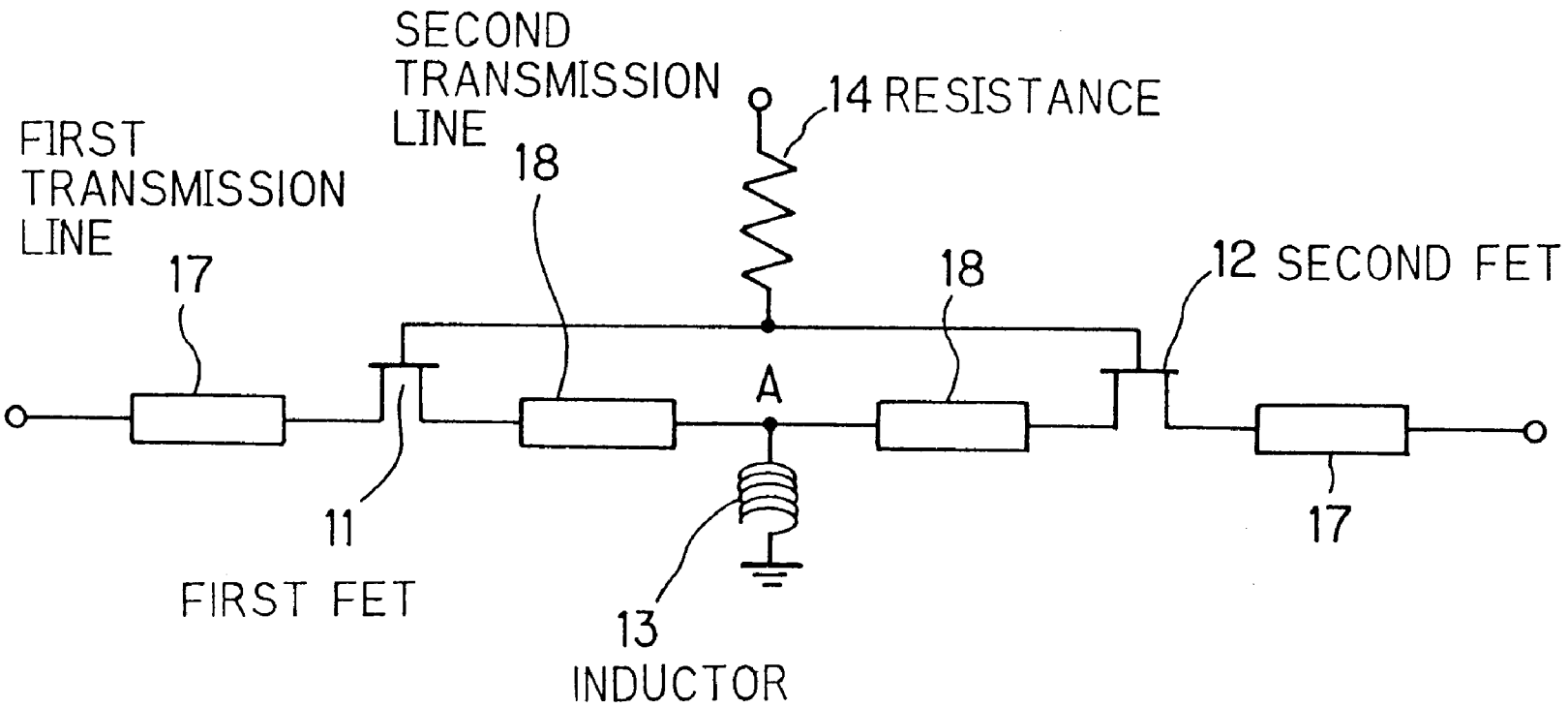
FIG. 10 is a circuit diagram showing the unit circuit of a switching circuit in a second preferred embodiment according to the invention.
Figure 11:
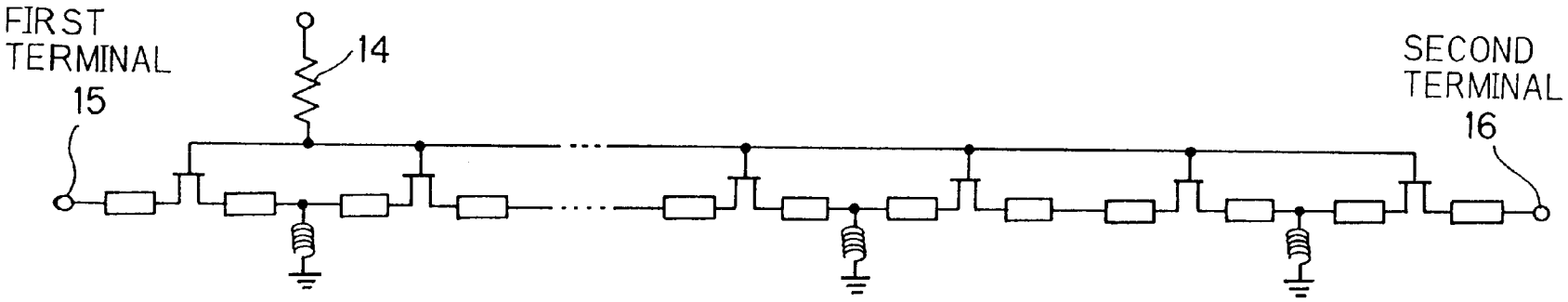
FIG. 11 is a circuit diagram showing the switching circuit in the second embodiment.

A switching circuit in the second preferred embodiment will be explained in FIGS. 10 and 11. FIG. 10 is a circuit diagram showing a unit circuit as the component of the switching circuit in the second embodiment. FIG. 11 is a circuit diagram showing the whole composition of the switching circuit in the second embodiment.

In FIG. 10, the unit circuit is composed of a first FET 11 and a second FET 12 which have a drain to which a first transmission line 17 to operate as an inductor is connected and a source to which a second transmission line 18 to operate as an inductor is connected, and an inductor 13. The first and second FETs 11, 12 are in series connected through the second transmission lines 18. One end of inductor 13 is connected to a connection point A between the first FET 11 and the second FET 12, and another end of the inductor 13 is grounded. Also, the gates of the first FET 11 and the second FET 12 are commonly connected, and a resistance 14 is connected thereto.

As shown in FIG. 11, the switching circuit in the second embodiment is composed of several unit circuits as shown in FIG. 10 to be connected in series. The gates of FETs as components of the respective unit circuits are commonly connected, and a bias voltage is equally applied through the resistance 14 to them. Also, both ends of the switching circuit are connected with a first terminal 15 and a second terminal 16.

In this composition, when FETs are turned off, each of the unit circuits is equivalent to a T-type high-pass filter like the first embodiment. Therefore, an ON-state with low insertion loss and a wide band characteristic can be realized between the first terminal 15 and the second terminal 16, i.e., in the switching circuit.

On the other hand, when FETs are turned on, due to the resistance of several FETs connected in series, an OFF-state with high isolation and a wide band characteristic can be realized between the first terminal 15 and the second terminal 16, i.e., in the switching circuit:.

Meanwhile, in designing, a frequency characteristic between the first terminal 15 and the second terminal 16 can be determined by a capacitance of FET and an inductor value.

Figure 12:
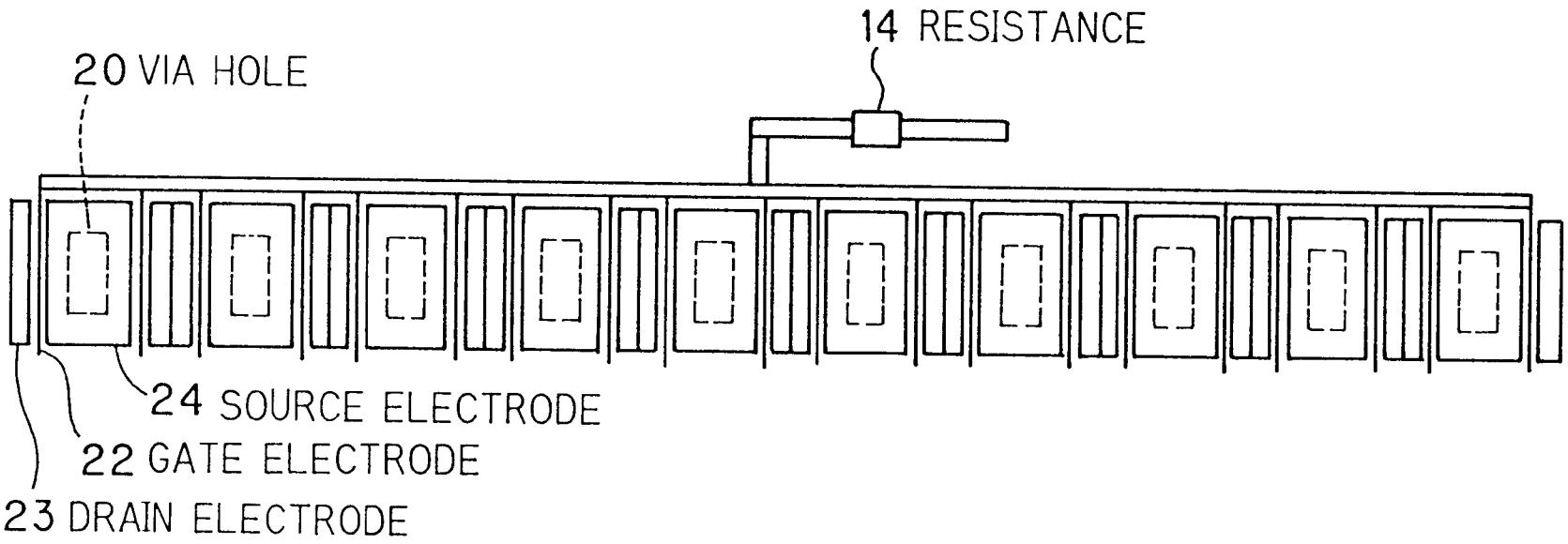
FIG. 12 is a plan view showing a semiconductor device in a second preferred embodiment according to the invention.
Figure 13:
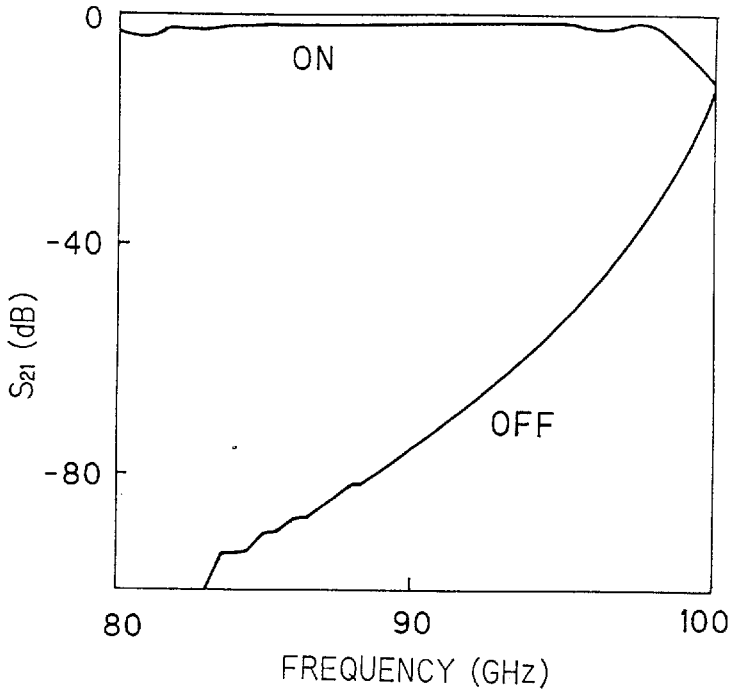
FIG. 13 is a graph showing a frequency characteristic of the semiconductor device in FIG. 12.
Figure 14:
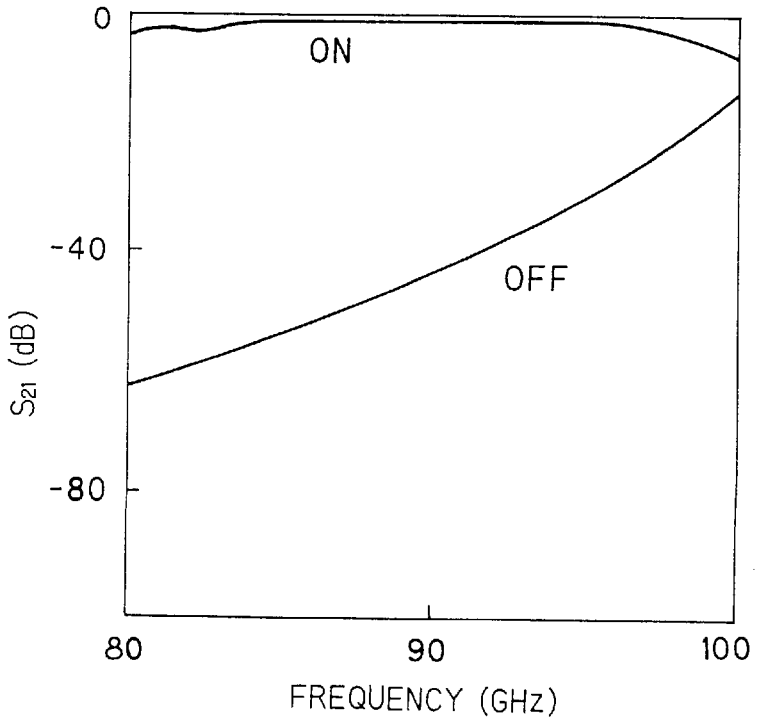
FIG. 14 is a graph showing a frequency characteristic of the semiconductor device where six unit elements in the second embodiment are connected in series.

Referring to FIGS. 12 to 14, a semiconductor device to form the switching circuit in the second embodiment will be explained below.

The semiconductor device in the second embodiment is, based upon is the switching circuit in FIG. 11, composed of ten unit circuits connected in series, each of which includes a AlGaAs system hetero-junction FET with a gate length of 0.15 μm and a gate width of 100 μm, the first transmission line 17 of 5 μm long and 100 μm wide, and the second transmission line 18 of 150 μm long and 100 μm wide. Also, in turning off FETs, the capacitance is 30 pF and the inductance is 13 pH.

FIG. 12 is a plan view showing the semiconductor device in the second embodiment. As shown, each FET is composed of a gate electrode 22, and a drain electrode 23 and a source electrode 24 disposed sandwiching the gate electrode 22. Meanwhile, the drain electrode 23 and the source electrode 24 also serve as a transmission line, Also, the source electrodes 24 of two FETs are connected each other, and the connection point of two source electrodes 24 is connected through a via hole 20 to serve as an inductor 13 (see FIG. 10) to the back surface of a semiconductor substrate where ground metal is formed. Thus, a unit element is composed of two FETs including the transmission lines and the via hole 20, The semiconductor device in the second embodiment is composed of ten unit elements connected in series.

Also, the gate electrodes 22 of FETs are commonly connected, and a bias voltage is equally applied through the resistance 14 provided on a bias line to them. Also, both ends of the semiconductor device are connected with the first terminal 15 and second terminal 16 (not shown).

FIG. 13 shows a frequency characteristic of the semiconductor device in FIG. 12. A label "ON"in FIG. 13 indicates frequency characteristics of an ON (turn-on or closed) state of the switch. A label "OFF" indicates frequency characteristics of an OFF (turn-off or opened) state characteristics of the switch. As shown in FIG. 13, in this embodiment, a characteristic with insertion loss lower than 1.8 dB and isolation higher than 34 dB can be obtained in a wide frequency range of 84 GHz to 98 GHz. Also, the effective band is 14 GHz.

FIG. 14 shows a frequency characteristic of another example of the semiconductor device in the second embodiment in which six unit elements are connected in series. A label "ON" in FIG. 14 indicates frequency characteristics of an ON (turn-on or closed) state of the switch. A label "OFF" indicates frequency characteristics of an OFF (turn-off or opened) state characteristics of the switch. As shown in FIG. 14, in this example, a characteristic with insertion loss lower than 1.7 dB and isolation higher than 25 dB can be obtained in a wide frequency range of 83 GHz to 97 GHz. Also, the effective band is 14 GHz.

In comparing FIGS. 13 and 14, it will be easily appreciated that, as the number of unit elements is decreased, isolation is likely to reduce because the resistance value in OFF-state is reduced.

Figure 15:
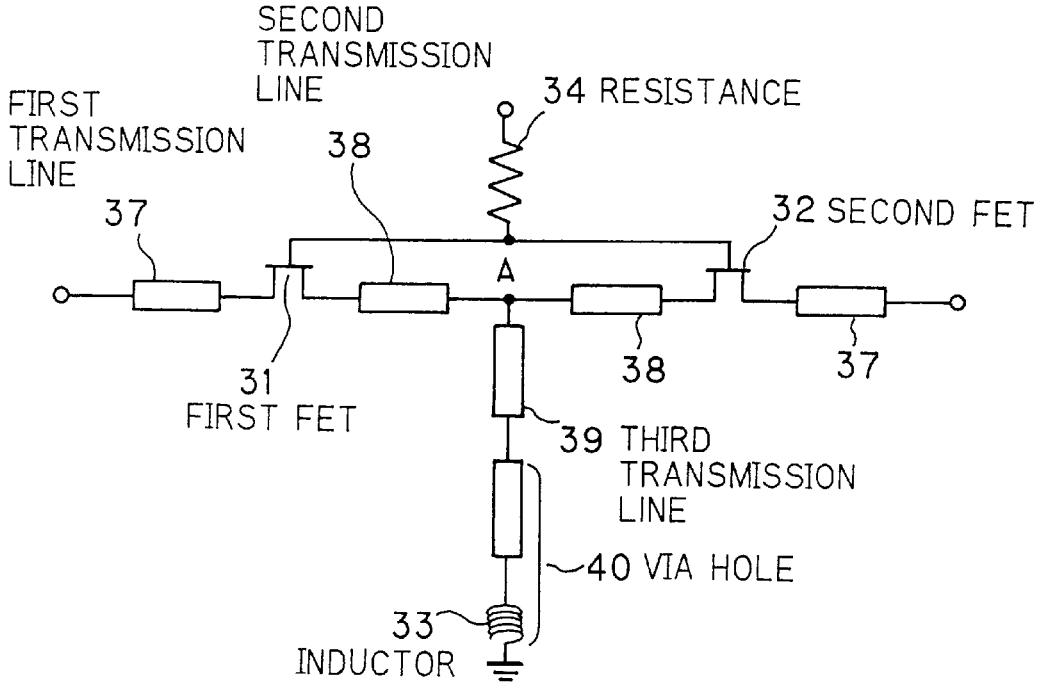
FIG. 15 is a circuit diagram showing the unit circuit of a switching circuit in a third preferred embodiment according to the invention
Figure 16:
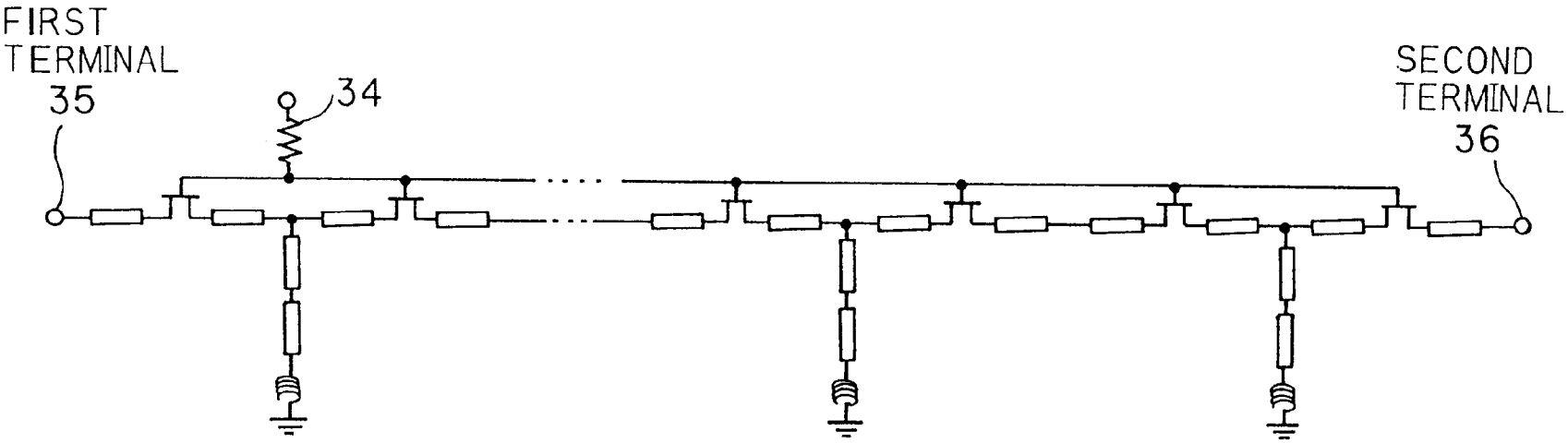
FIG. 16 is a circuit diagram showing the switching circuit in the third embodiment.

A switching circuit in the third preferred embodiment will be explained in FIGS. 15 and 16. FIG. 15 is a circuit diagram showing a unit circuit as the component of the switching circuit in the third embodiment. FIG. 16 is a circuit diagram showing the whole composition of the switching circuit in the third embodiment.

In FIG. 15, the unit circuit is composed of a first FET 31 and a second FET 32 which have a drain to which a first transmission line 37 is connected and a source to which a second transmission line 38 is connected, a third transmission line 39, and an inductor 33. In this embodiment, a via hole 40 is used as the inductor 33. The first and second FETs 31, 32 are in series connected through the second transmission lines 38. The third transmission line 39 and the via hole 40 are connected to a connection point A between the first FET 31 and the second FET 32, and one end (not connected with the third transmission line 39) of the via hole 40 is grounded. Also, the gates of the first FET 31 and the second FET 32 are commonly connected, and a resistance 34 is connected thereto.

As shown in FIG. 16, the switching circuit in the third embodiment is composed of several unit circuits as shown in FIG. 15 to be connected in series. The gates of FETs as components of the respective unit circuits are commonly connected, and a bias voltage is equally applied through the resistance 34 to them. Also, both ends of the switching circuit are connected with a first terminal 35 and a second terminal 36.

In this composition, when FETs are turned off, each of the unit circuits is equivalent to a T-type high-pass filter like the first and second embodiments. Therefore, an ON-state with low insertion lose and a wide band characteristic can be realized between the first terminal 35 and the second terminal 36.

On the other hand, when FETs are turned on, due to the resistance of several FETs connected in series, an OFF-state with high isolation and a wide band characteristic can be realized between the first terminal 35 and the second terminal 36.

Meanwhile, in designing, a frequency characteristic between the first terminal 35 and the second terminal 36 can be determined by a capacitance of FET and the width and length of the first to third transmission lines 37, 38 and 39.

Figure 17:
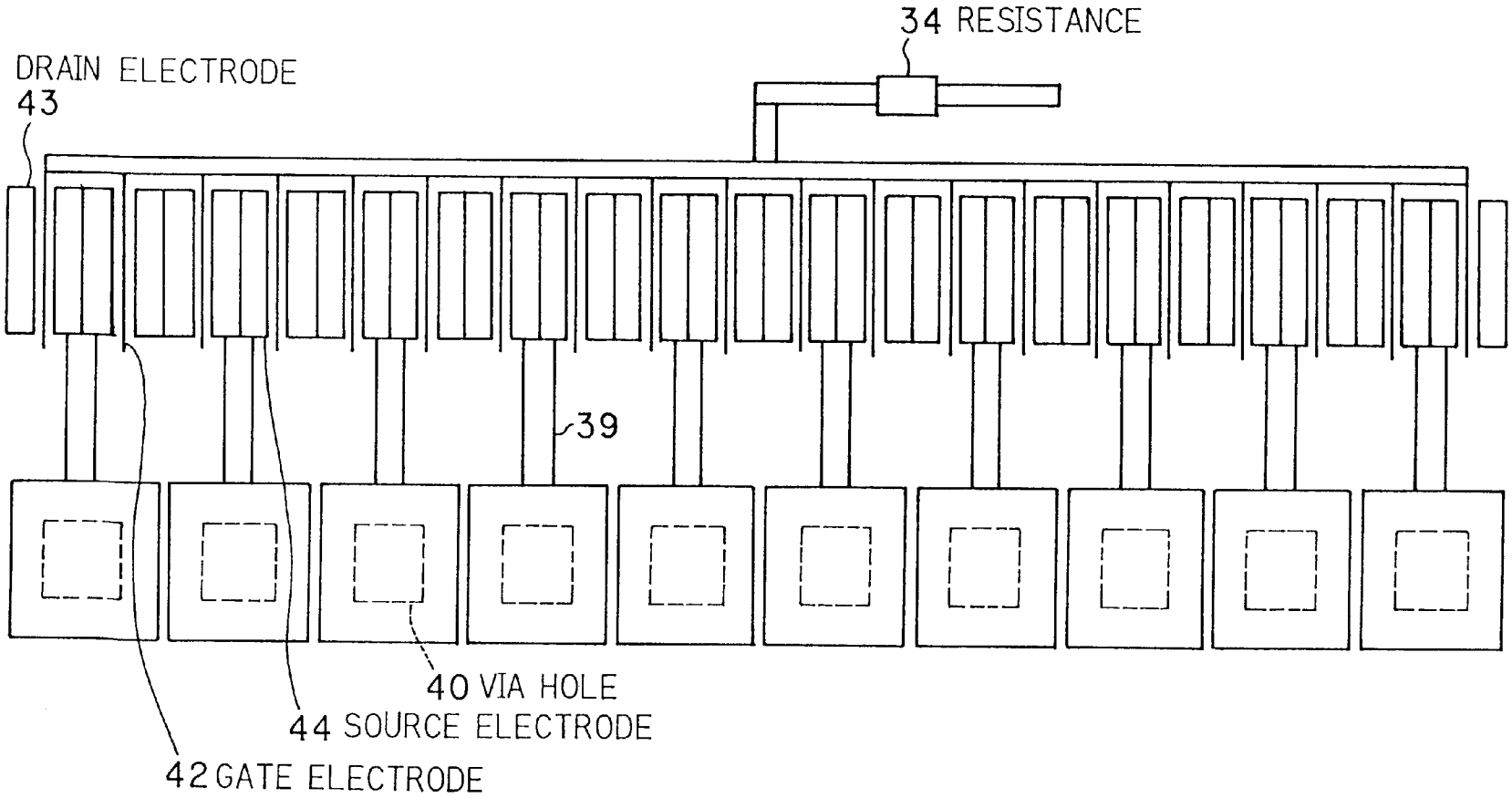
FIG. 17 is a plan view showing a semiconductor device in a third preferred embodiment according to the invention.
Figure 18:
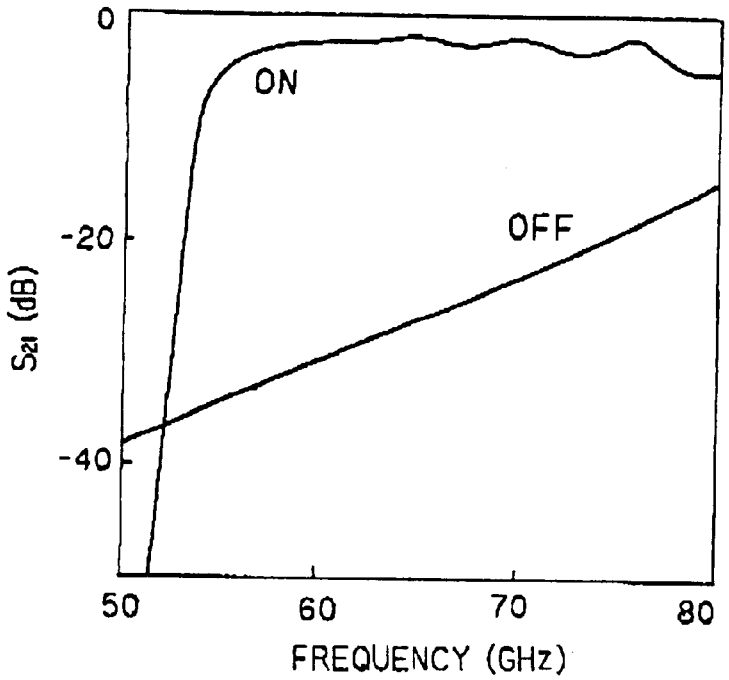
FIG. 18 is a graph showing a frequency characteristic of the semiconductor device in FIG. 17.

Referring to FIGS. 17 and 18, a semiconductor device to form the switching circuit in the third embodiment will be explained below, The semiconductor device in the third embodiment is, based upon the switching circuit in FIG. 16, composed of ten unit circuits connected in series, each of which includes a AlGaAs system hetero-junction FET with a gate length of 0.15 μm and a gate width of 100 μm, the first transmission line 37 of 5 μm long and 100 μm wide, the second transmission line 38 of 5 μm long and 100 μm wide, the third transmission line 39 of 150 μm long and 25 μm wide, and the via hole 40 with an inductance of 13 pH formed under the electrode of 50 μm long and 50 μm wide. Also, in turning off FETS, the capacitance is 30 pF and the inductance is 13 pH.

FIG. 17 is a plan view showing the semiconductor device in the third embodiment. As shown, each FET is composed of a gate electrode 42, and a drain electrode 43 and a source electrode 44 disposed sandwiching the gate electrode 42. Meanwhile, the drain electrode 43 and the source electrode 44 also serve as a transmission line.

Also, the source electrodes 44 of two FETs are connected to each other, and the connection point of two source electrodes 44 is connected through the third transmission line 39 and the via hole 40 to serve as an inductor (see FIG. 16) to the back surface of a semiconductor substrate where ground metal is formed. Thus, a unit element is composed of two FETs including the transmission lines, the third transmission line 39 and the via hole 40. The semiconductor device in the third embodiment is composed of ten unit elements connected in series.

Also, the gate electrodes 42 of FETs are commonly connected, and a bias voltage is equally applied through the resistance 34 provided on a bias line to them. Also, both ends of the semiconductor device are connected with the first terminal 35 and second terminal 36 (not shown).

FIG. 18 shows a frequency characteristic of the semiconductor device in FIG. 17. A label "ON" in FIG. 18 indicates frequency characteristics of an ON (turn-on or closed) state of the switch. A label "OFF" indicates frequency characteristics of an OFF (turn-off or opened) state characteristics of the switch. As shown in FIG. 18, in this embodiment, a characteristic with insertion loss lower than 2.6 dB and isolation higher than 22.5 dB can be obtained in a wide frequency range of 59 GHz to 71 GHz. Also, the effective band is 12 GHz.

Figure 19:
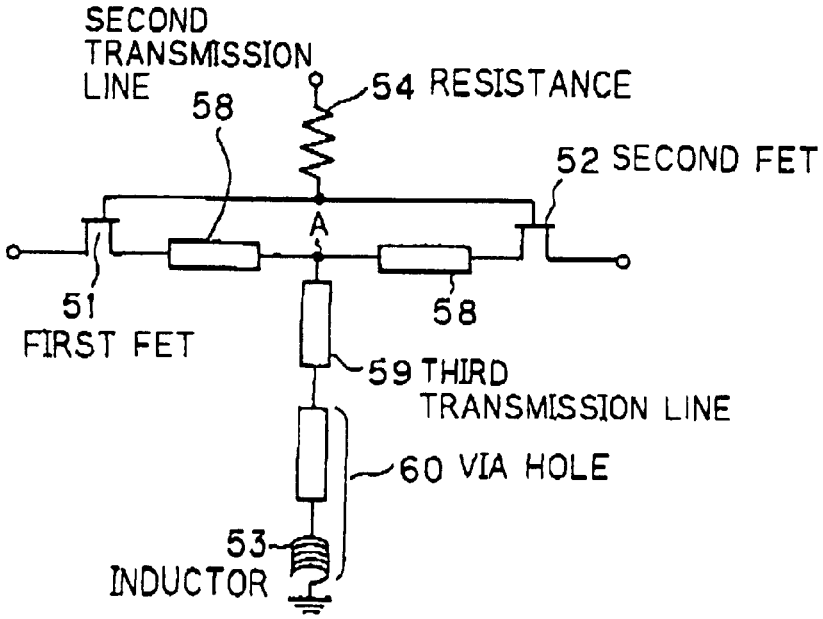
FIG. 19 is a circuit diagram showing the unit circuit of a switching circuit in a fourth preferred embodiment according to the invention.
Figure 20:
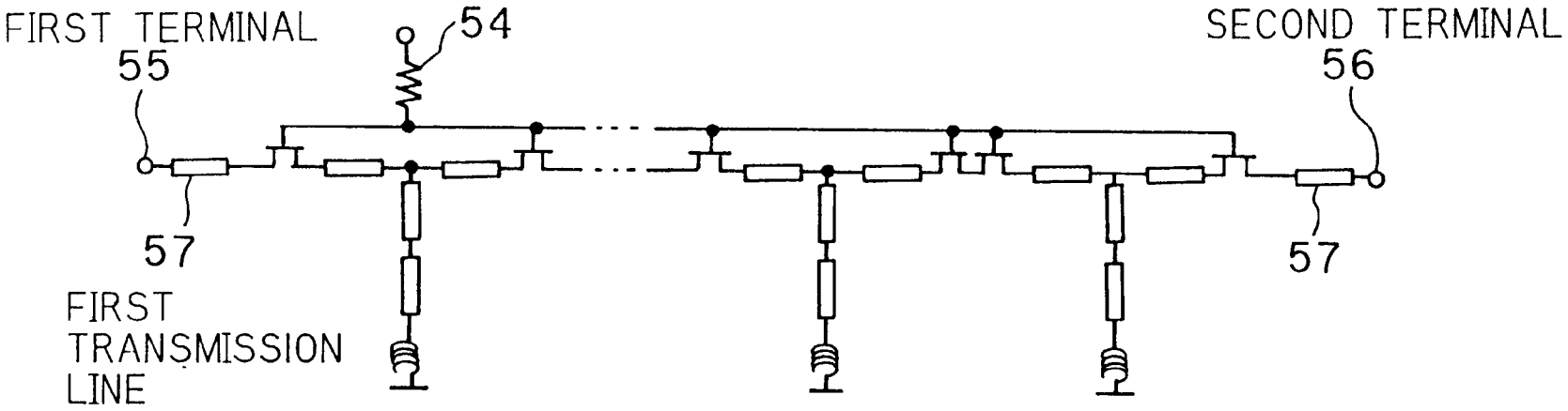
FIG. 20 is a circuit diagram showing the switching circuit in the fourth embodiment.

A switching circuit in the fourth preferred embodiment will be explained in FIGS. 19 and 20. FIG. 19 is a circuit diagram showing a unit circuit as the component of the switching circuit in the fourth embodiment. FIG. 20 is a circuit diagram showing the whole composition of the switching circuit in the fourth embodiment.

As shown in FIG. 19, the unit circuit in this embodiment is composed eliminating the first transmission line from the unit circuit in the third embodiment. Namely, the unit circuit is composed of a first FET 51 and a second FET 52 which have a source to which a second transmission line 58 is connected, a third transmission line 59, and an inductor 53. In this embodiment, a via hole 60 is used as the inductor 53. The first and second FETs 51, 52 are in series connected through the second transmission lines 58. The third transmission line 59 and the via hole 60 are connected to a connection point A between the first FET 51 and the second FET 52, and one end (not connected with the third transmission line 59) of the via hole 60 is grounded. Also, the gates of the first FET 51 and the second FET 52 are commonly connected, and a resistance 54 is connected thereto.

As shown in FIG. 20, the switching circuit in the fourth embodiment is composed of several unit circuits as shown in FIG. 19 to be connected in series. The gates of FETs as components of the respective unit circuits are commonly connected, and a bias voltage is equally applied through the resistance 54 to them. Also, both ends of the switching circuit are connected with a first terminal 55 and a second terminal 56 through a respective first transmission line 57.

In this composition, when FETs are turned off, each of the unit circuits is equivalent to a T-type high-pass filter like the first to third embodiments. Therefore, an ON-state with low insertion loss and a wide band characteristic can be realized between the first terminal 55 and the second terminal 56.

On the other hand, when FETs are turned on, due to the resistance of several FETs connected in series, an OFF-state with high isolation and a wide band characteristic can be realized between the first terminal 55 and the second terminal 56.

Meanwhile, in designing, a frequency characteristic between the first terminal 55 and the second terminal 56 can be determined by a capacitance of FET and the width and length of the second and third transmission lines 58 and 59.

Figure 21:
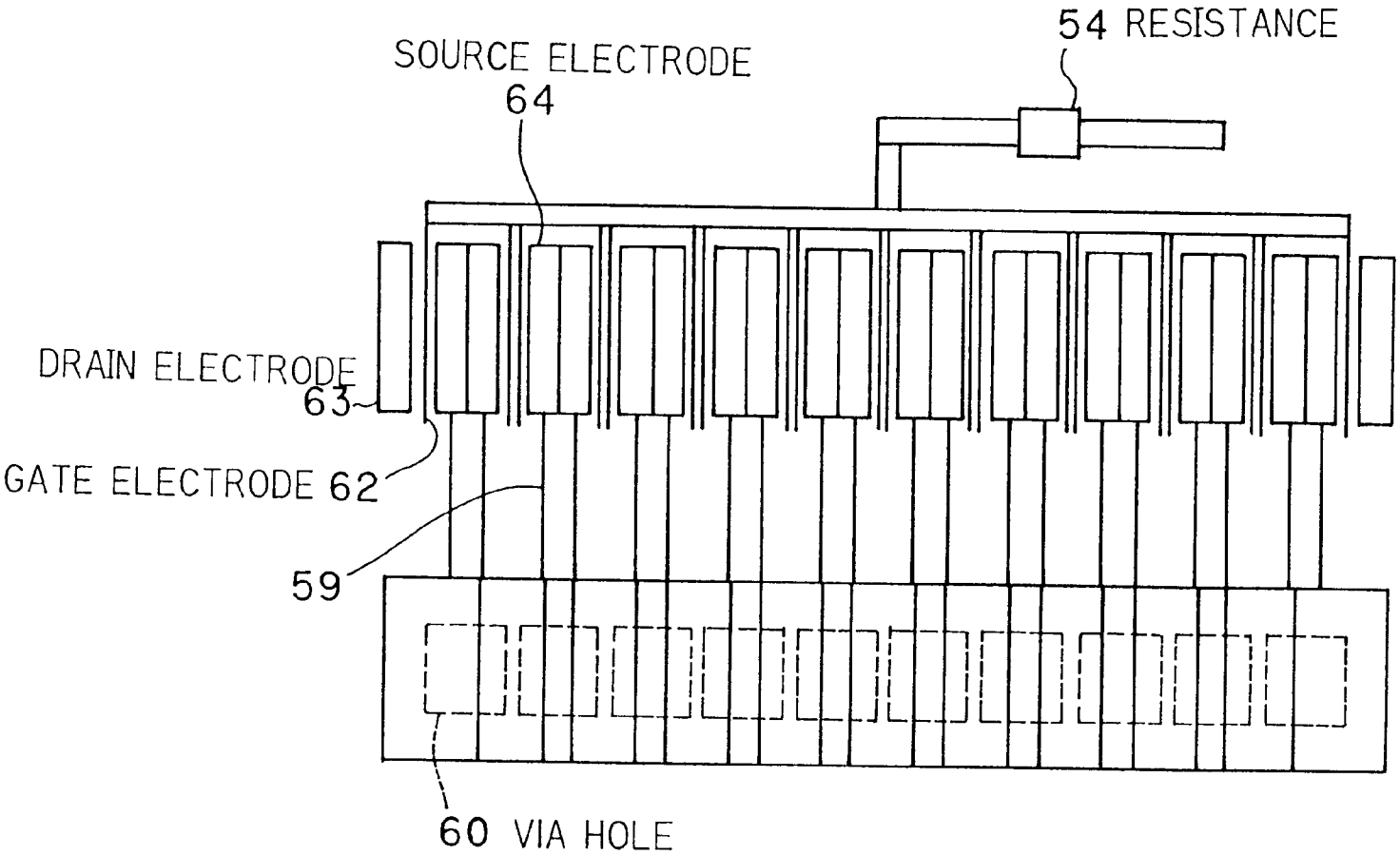
FIG. 21 is a plan view showing a semiconductor device in a fourth preferred embodiment according to the invention.
Figure 22:
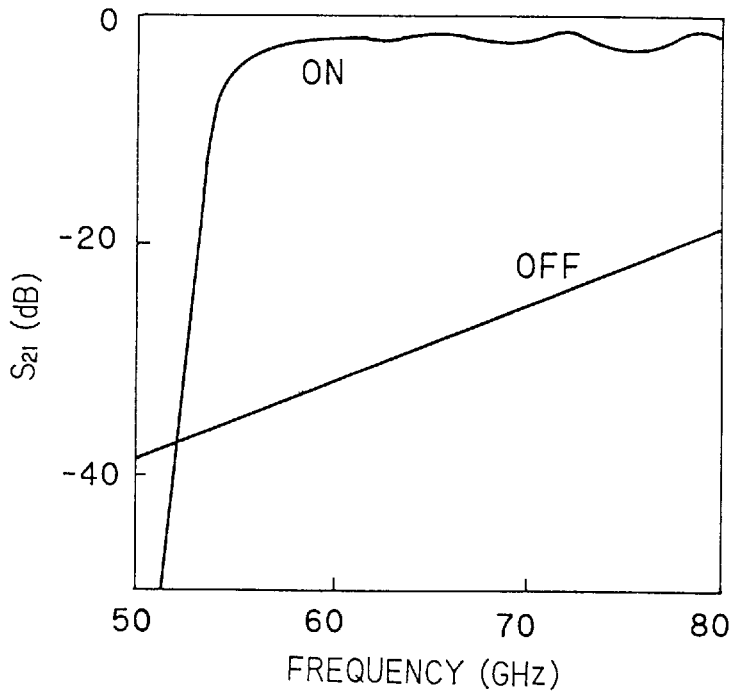
FIG. 22 is a graph showing a frequency characteristic of the semiconductor device in FIG. 21.

Referring to FIGS. 21 and 22, a semiconductor device to form the switching circuit in the fourth embodiment will be explained below.

The semiconductor device in the fourth embodiment is, based upon the switching circuit in FIG. 20, composed of ten unit circuits connected in series, each of which includes a AlGaAs system hetero-junction FET with a gate length of 0.15 μm and a gate width of 100 μm, a first transmission line 57 of 5 μm long and 100 μm wide, the second transmission line 58 of 5 μm long and 100 μm wide, the third transmission line 59 of 150 μm long and 25 μm wide, and the via hole 60 with an inductance of 13 pH formed under the electrode of 50 μm long and 50 μm wide. Also, in turning off FETs, the capacitance is 30 pF and the inductance is 13 pH.

FIG. 21 is a plan view showing the semiconductor device in the fourth embodiment. As shown, each FET is composed of a gate electrode 62, a drain electrode 63 and a source electrode 64 disposed an one side of the gate electrode 62. Meanwhile, the source electrode 64 also serves as a transmission line.

Also, the source electrodes 64 of two FETs are connected each other, and the connection point of two source electrodes 64 is connected through the third transmission line 59 and the via hole 60 to serve as an inductor 53 (se FIG. 19) to the back surface of a semiconductor substrate where ground metal is formed. Thus, a unit element is composed of two FETs including the transmission lines, the third transmission line 59 and the via hole 60. The semiconductor device in the fourth embodiment is composed of ten unit elements connected in series.

Also, the gate electrodes 62 of FETs are commonly connected, and a bias voltage is equally applied through the resistance 54 provided on a bias line to them. Also, both ends of the semiconductor device are connected with the first terminal 55 and second terminal 56 (not shown).

Meanwhile, in FIG. 21, drain electrodes for FETs except FETs disposed on both ends of the semiconductor device are not shown, but drain regions are formed between two gate electrodes continuously formed.

FIG. 22 shows a frequency characteristic of the semiconductor device in FIG. 21. A label "ON" in FIG. 22 indicates frequency characteristics of an ON (turn-on or closed) state of the switch. A label "OFF" indicates frequency characteristics of an OFF (turn-off or opened) state characteristics of the switch. As shown in FIG. 22, in this embodiment, a characteristic with insertion loss lower than 2.6 dB and isolation higher than 23 dB can be obtained in a wide frequency range of 58 GHz to 73 GHz. Also, the effective band is 15 GHz.

Figure 23:
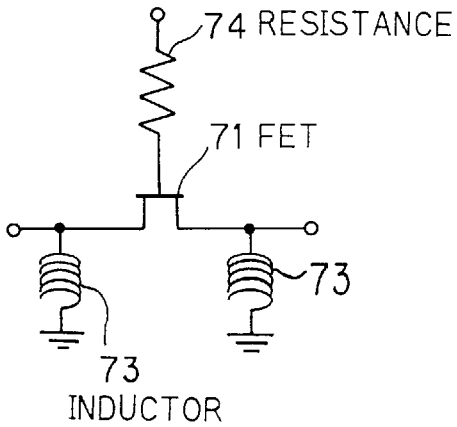
FIG. 23 is a circuit diagram showing the unit circuit of a switching circuit in a fifth preferred embodiment according to the invention.
Figure 24:
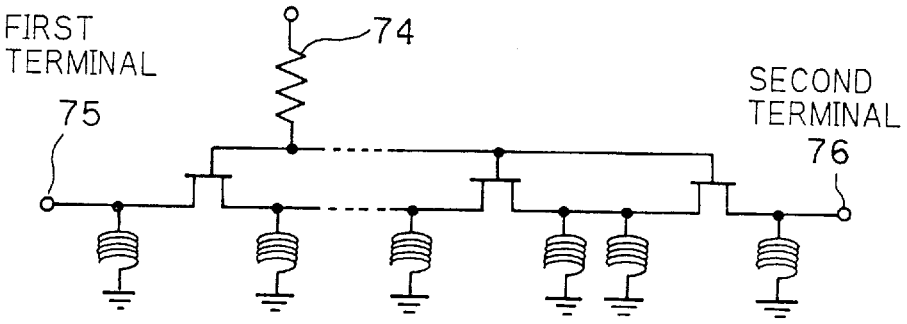
FIG. 24 is a circuit diagram showing the switching circuit in the fifth embodiment.

A switching circuit in the fifth preferred embodiment will be explained in FIGS. 23 and 24. FIG. 23 is a circuit diagram showing a unit circuit as the component of the switching circuit in the fifth embodiment. FIG. 24 is a circuit diagram showing the whole composition of the switching circuit in the fifth embodiment.

As shown in FIG. 23, the unit circuit in this embodiment is composed of FET 71 which has a source and a drain to each of which an inductor 73 grounded at its one end is connected. Also, a resistance 74 is connected to the gate of FET 71.

As shown in FIG. 24, the switching circuit in the fifth embodiment is composed of several unit circuits as shown in FIG. 23 to be connected in series. The gates of FETs as components of the respective unit circuits are commonly connected, and a bias voltage is equally applied through the resistance 74 to them. Also, both ends of the switching circuit are connected with a first terminal 75 and a second terminal 76.

In this composition, when FETs are turned off, each of the unit circuits is equivalent to a π-type high-pass filter. Therefore, an ON-state with low insertion loss and a wide band characteristic can be realized between the first terminal 75 and the second terminal 76, like the first embodiment.

On the other hand, when FETs are turned on, due to the resistance of several FETs connected in series, an OFF-state with high isolation and a wide band characteristic can be realized between the first terminal 75 and the second terminal 76.

Meanwhile, in designing, a frequency characteristic between the first terminal 75 and the second terminal 76 can be determined by a capacitance of FET and an inductor value.

Figure 25:
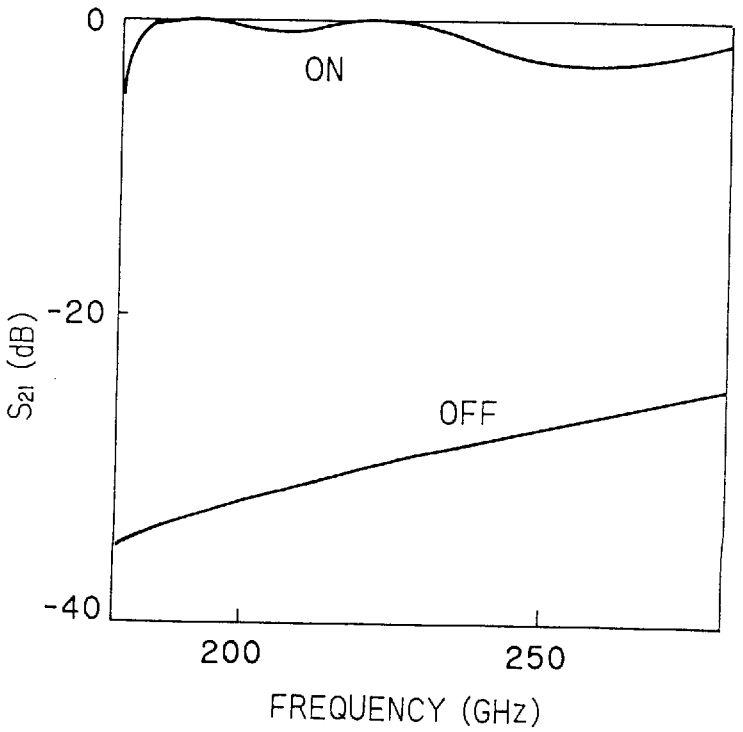
FIG. 25 is a graph showing a frequency characteristic of a semiconductor device in a fifth preferred embodiment according to the invention.

Referring to FIG. 25, a semiconductor device to form the switching circuit in the fifth embodiment will be explained below.

The semiconductor device in the fifth embodiment is, based upon the switching circuit in FIG. 24, composed of eight unit circuits connected in series, each of which includes a AlGaAs system hetero-junction FET with a gate length of 0.15 μm and a gate width of 100 μm. Also, in turning off FETs, the capacitance is 30 pF and the inductance is 13 pH.

FIG. 25 shows a frequency characteristic of the semiconductor device in the fifth embodiment. A label "ON" in FIG. 25 indicates frequency characteristics of an ON (turn-on or closed) state of the switch. A label "OFF" indicates frequency characteristics of an OFF (turn-off or opened) state characteristics of the switch. As shown in FIG. 25, in this embodiment, a characteristic with insertion loss lower than 1.1 dB and isolation higher than 28.7 dB can be obtained in a wide frequency range of 183 GHz to 235 GHz. Also, the effective band is 52 GHz.

Figure 26:
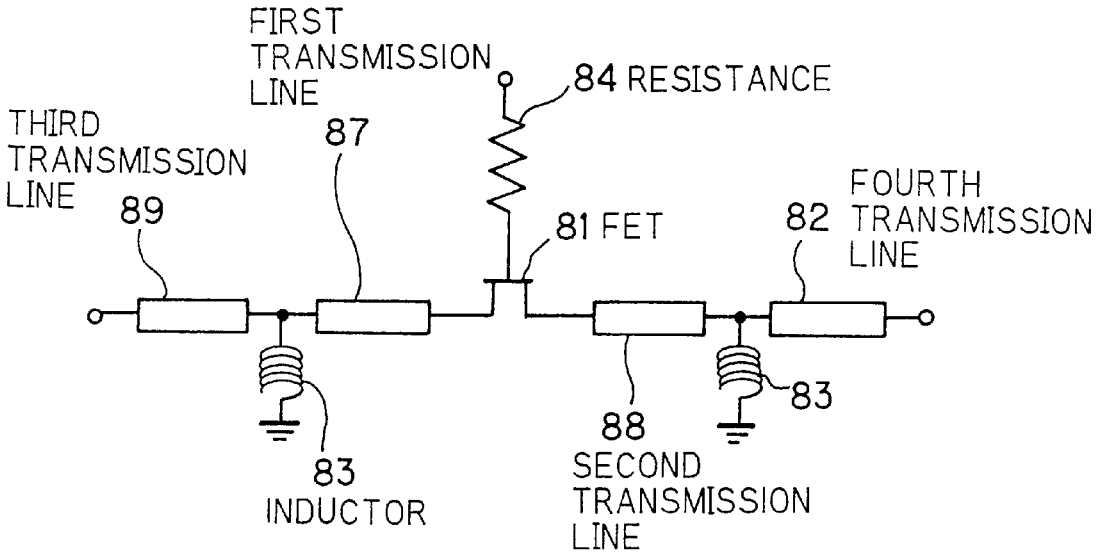
FIG. 26 is a circuit diagram showing the unit circuit of a switching circuit in a sixth preferred embodiment according to the invention.
Figure 27:
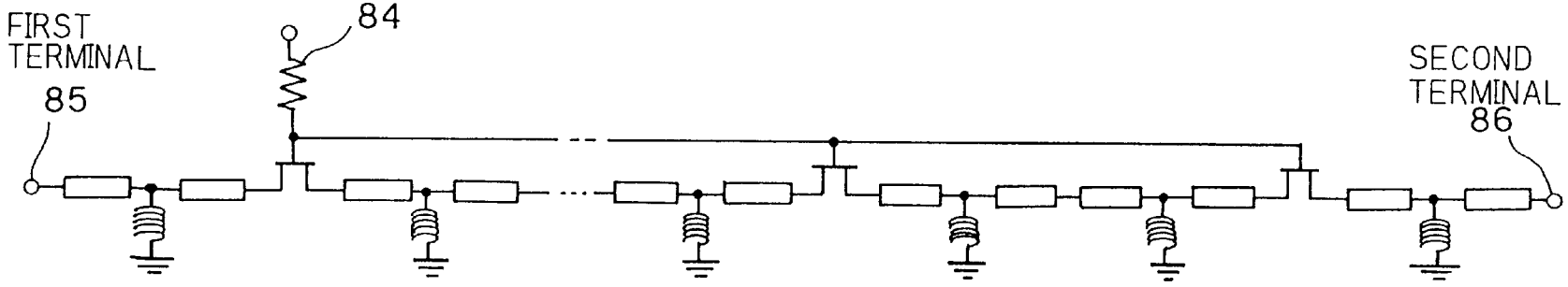
FIG. 27 is a circuit diagram showing the switching circuit in the sixth embodiment.

A switching circuit in the sixth preferred embodiment will be explained in FIGS. 26 and 27. FIG. 26 is a circuit diagram showing a unit circuit as the component of the switching circuit in the sixth embodiment. FIG. 27 is a circuit diagram showing the whole composition of the switching circuit in the sixth embodiment.

As shown in FIG. 26, the unit circuit in this embodiment is composed of FET 81 which has a source to which a first transmission line 87 and a third transmission line 89 are connected and a drain to which a second transmission line 88 and a fourth transmission line 82 are connected, and two inductors 83. Also, one end of the inductor 83 is connected to a connection point between the first transmission line 87 and the third transmission line 89 or a connection point between the second transmission line 88 and the fourth transmission line 82, and another end of the inductor 83 is grounded. Also, a resistance 84 is connected to the gate of FET 81.

As shown in FIG. 27, the switching circuit in the sixth embodiment is composed of several unit circuits as shown in FIG. 26 to be connected in series. The gates of FETs as components of the respective unit circuits are commonly connected, and a bias voltage is equally applied through the resistance 84 to them. Also, both ends of the switching circuits are connected with a first terminal 85 and a second terminal 86.

In this composition, when FETs are turned off, each of the unit circuits is equivalent to a π-type high-pass filter like the fifth embodiment. Therefore, an ON-state with low insertion loss and a wide band characteristic can be realized between the first terminal 85 and the second terminal 86.

On the other hand, when FETS are turned on, due to the resistance of several FETs connected in series, an OFF-state with high isolation and a wide band characteristic can be realized between the first terminal 85 and the second terminal 86.

Meanwhile, in designing, a frequency characteristic between the first terminal 85 and the second terminal 86 can be determined by a capacitance of FET, an inductor value, and the width and length of the first to fourth transmission lines 87, 88, 89 and 82.

Figure 28:
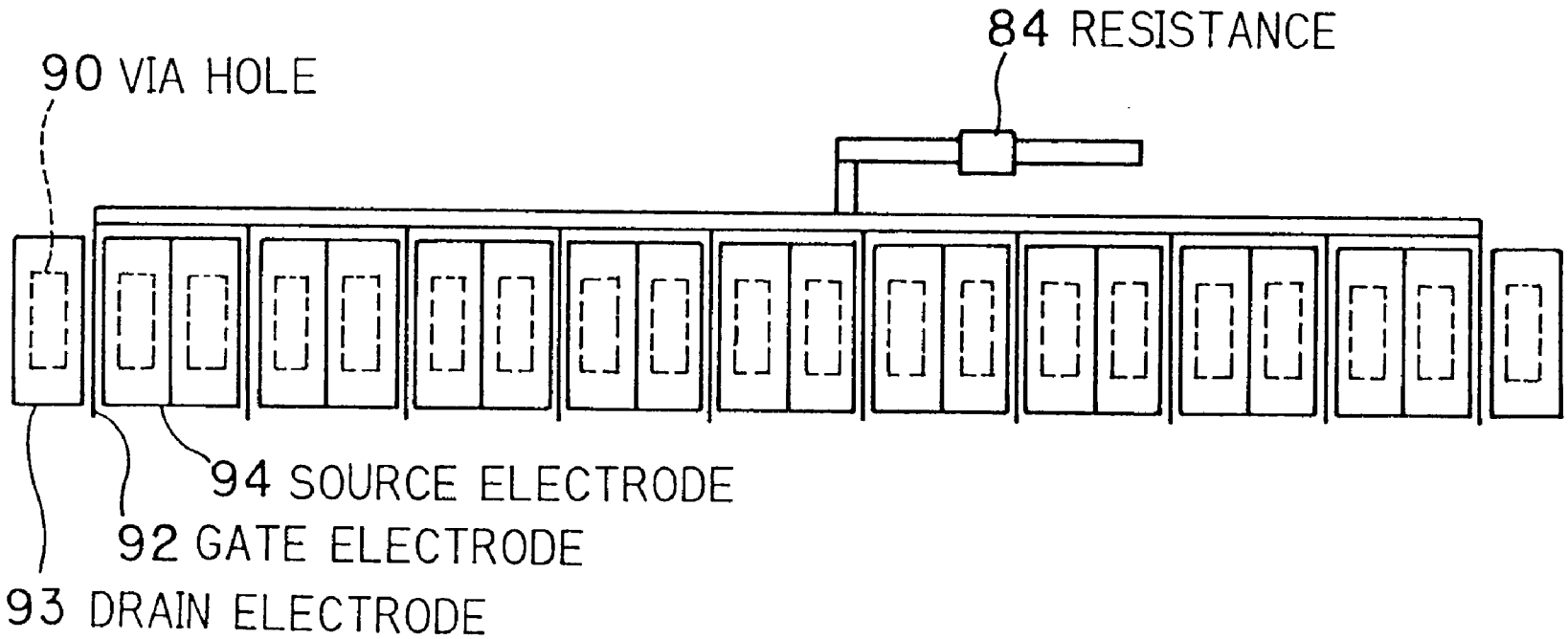
FIG. 28 is a plan view showing a semiconductor device in a sixth preferred embodiment according to the invention.
Figure 29:
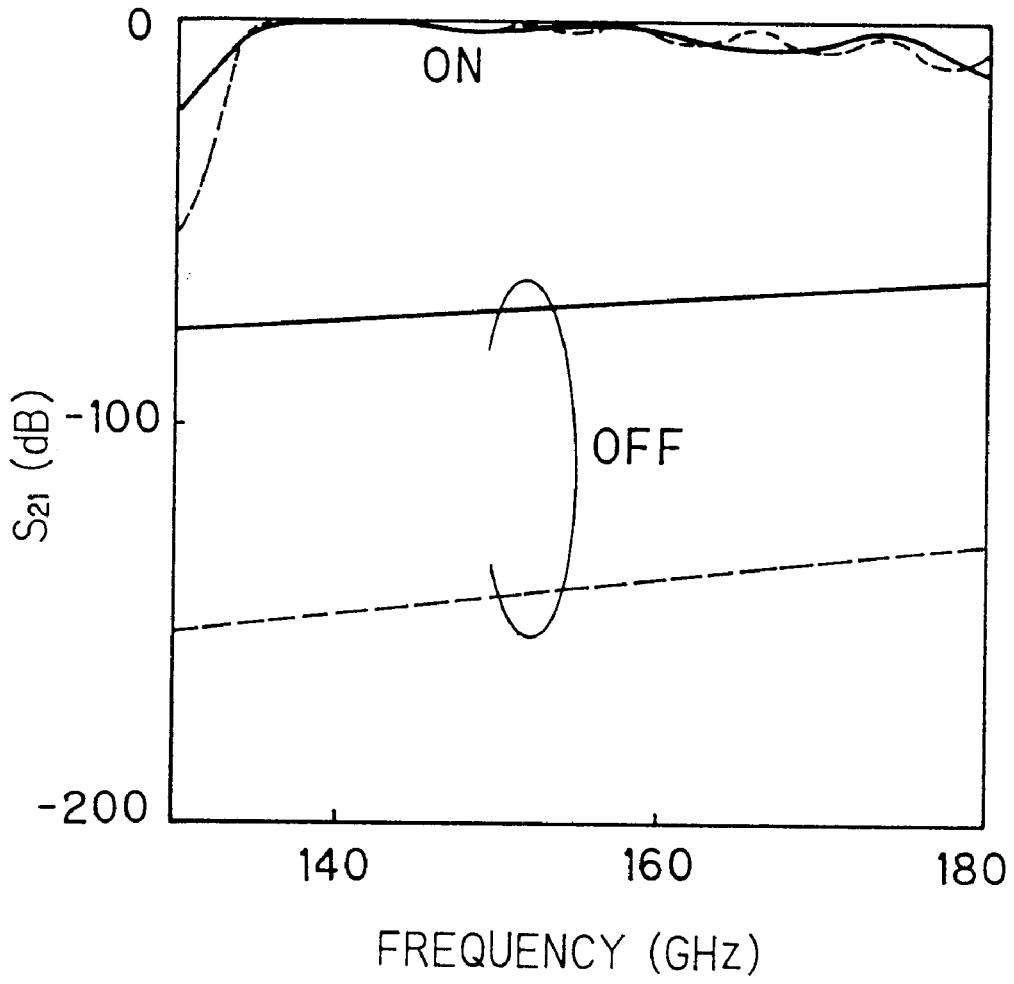
FIG. 29 is a graph showing a frequency characteristic of the semiconductor device in FIG. 28.

Referring to FIGS. 28 and 29, a semiconductor device to form the switching circuit in the sixth embodiment will be explained below.

The semiconductor device in the sixth embodiment is, based upon the switching circuit in FIG. 27, composed of ten unit circuits connected in series, each of which includes a AlGaAs system hetero-junction FET with a gate length of 0.15 μm and a gate width of 100 μm, the first to fourth transmission lines 87 to 89 and 82 of 5 μm long and 100 μm wide. Also, in turning off FETS, the capacitance is 30 pF and the inductance is 13 pH. The thickness of a semiconductor substrate is 40 μm.

FIG. 28 is a plan view showing the semiconductor device in the sixth embodiment. As shown, each FET is composed of a gate electrode 92, and a drain electrode 93 and a source electrode 94 disposed sandwiching the gate electrode 92. Meanwhile, the drain and source electrodes 93, 94 also serve as a transmission line.

Also, the drain and source electrodes 93, 94 of FET to also serve as a transmission line are connected through a via hole 90 to serve as the inductor 83 (see FIG. 26) to the back surface of a semiconductor substrate where ground metal is formed. Thus, a unit element is composed of FET including the transmission lines, and the via hole 90. The semiconductor device in the sixth embodiment is composed of ten unit elements connected in series.

Also, the gate electrodes 92 of FETs are commonly connected, and a bias voltage is equally applied through the resistance 84 provided on a bias line to them. Also, both ends of the semiconductor device are connected with the first terminal 85 and second terminal 86 (not shown).

FIG. 29 shows frequency characteristics of the semiconductor device in FIG. 28. A label "ON" in FIG. 29 indicates frequency characteristics of an ON (turn-on or closed) state of the switch. A label "OFF" indicates frequency characteristics of an OFF (turn-off or opened) state characteristics of the switch. In FIG. 29, a characteristic indicated by dotted lines corresponds to a frequency characteristic for ten unit circuits connected in series. In this case, the characteristic with insertion loss lower than 3.5 dB and isolation higher than 140 dB can be obtained in a wide frequency range of 134 GHz to 160 GHz. Also, the effective band is 26 GHz. On the other hand, a characteristic indicated by full lines corresponds to a frequency characteristic for five unit circuits connected in series. In this case, the characteristic with insertion loss lower than 3.5 dB and isolation higher than 68.6 dB can be obtained in a wide frequency range of 134 GHz to 162 GHz. Also, the effective band is 28 GHz.

A switching circuit in the seventh preferred embodiment will be explained in FIG. 30.

Figure 30:
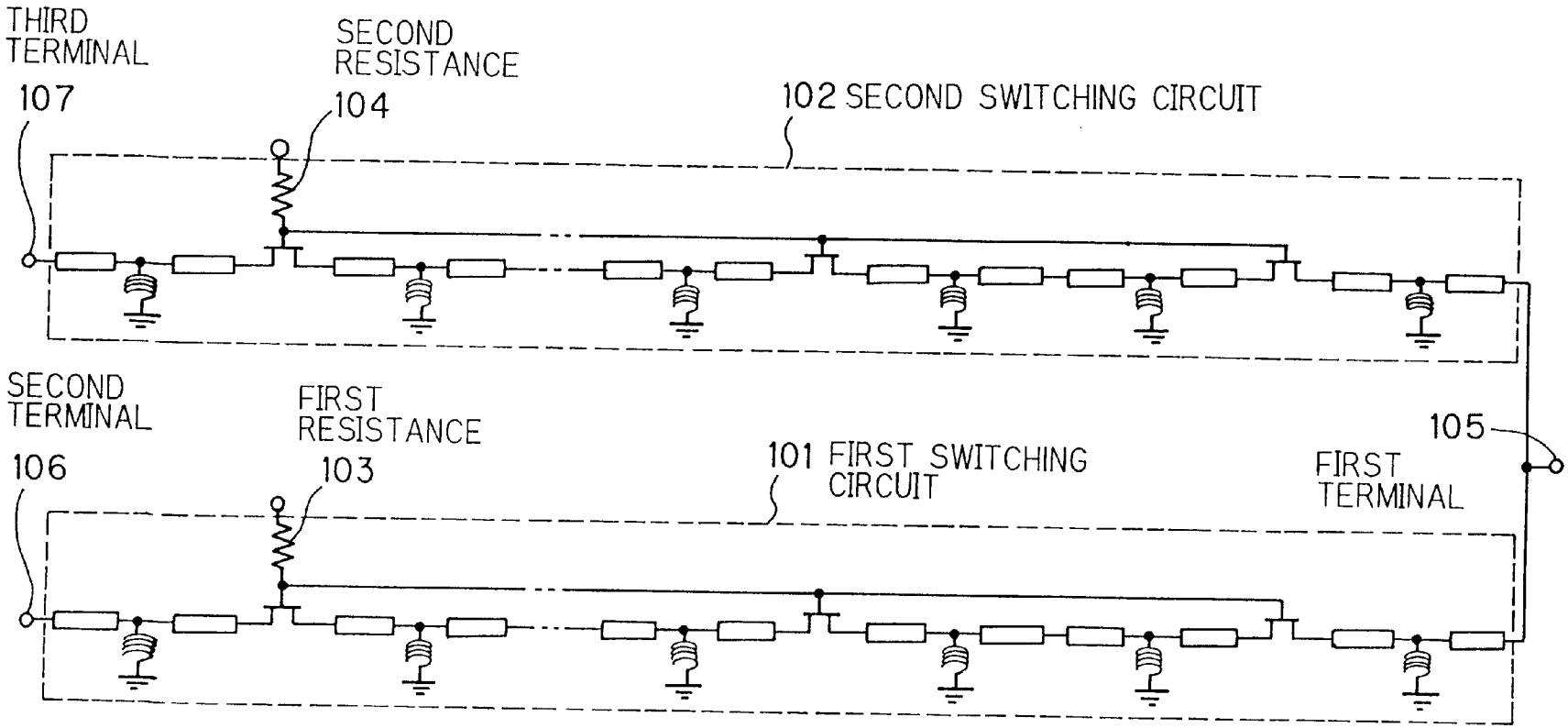
FIG. 30 is a circuit diagram showing a switching circuit in a seventh preferred embodiment according to the invention.

As shown in FIG. 30, the switching circuit in the seventh embodiment is composed using the two switching circuits in the sixth embodiment as shown in FIG. 27 where one-side terminals of the two switching circuits are commonly used. Namely, the switching circuit in this embodiment is composed of a first switching circuit 101 and a second switching circuit 102, each of which being composed of several unit circuits as shown in FIG. 26 to be connected in series. One-side ends of the first switching circuit 101 and second switching circuit 102 are commonly connected to a first terminal 105, and another end of the first switching circuit 101 is connected to a second terminal 106 and another end of the second switching circuit 102 is connected to a third terminal 107.

Also, the gates of FETs as components of the first switching circuit 101 are commonly connected, and a bias voltage is equally applied through a first resistance 103 to them. Similarly, the gates of FETs as components of the second switching circuit 102 are commonly connected, and a bias voltage is equally applied through a second resistance 104 to them.

The path of a RF signal can be switched by complementarily alternating a bias voltage applied to the first switching circuit 101 and a bias voltage applied to the second switching circuit 102.

Though the first to sixth embodiments show a single-pole single-throw switching circuit, this embodiment shows a single-pole double-throw switching circuit. Meanwhile, by using the several switching circuits in the first to sixth embodiments and commonly using one-side ends thereof, an arbitrary multiple-pole multiple-throw switching circuit for switching several RF paths can be formed.

Figure 31:
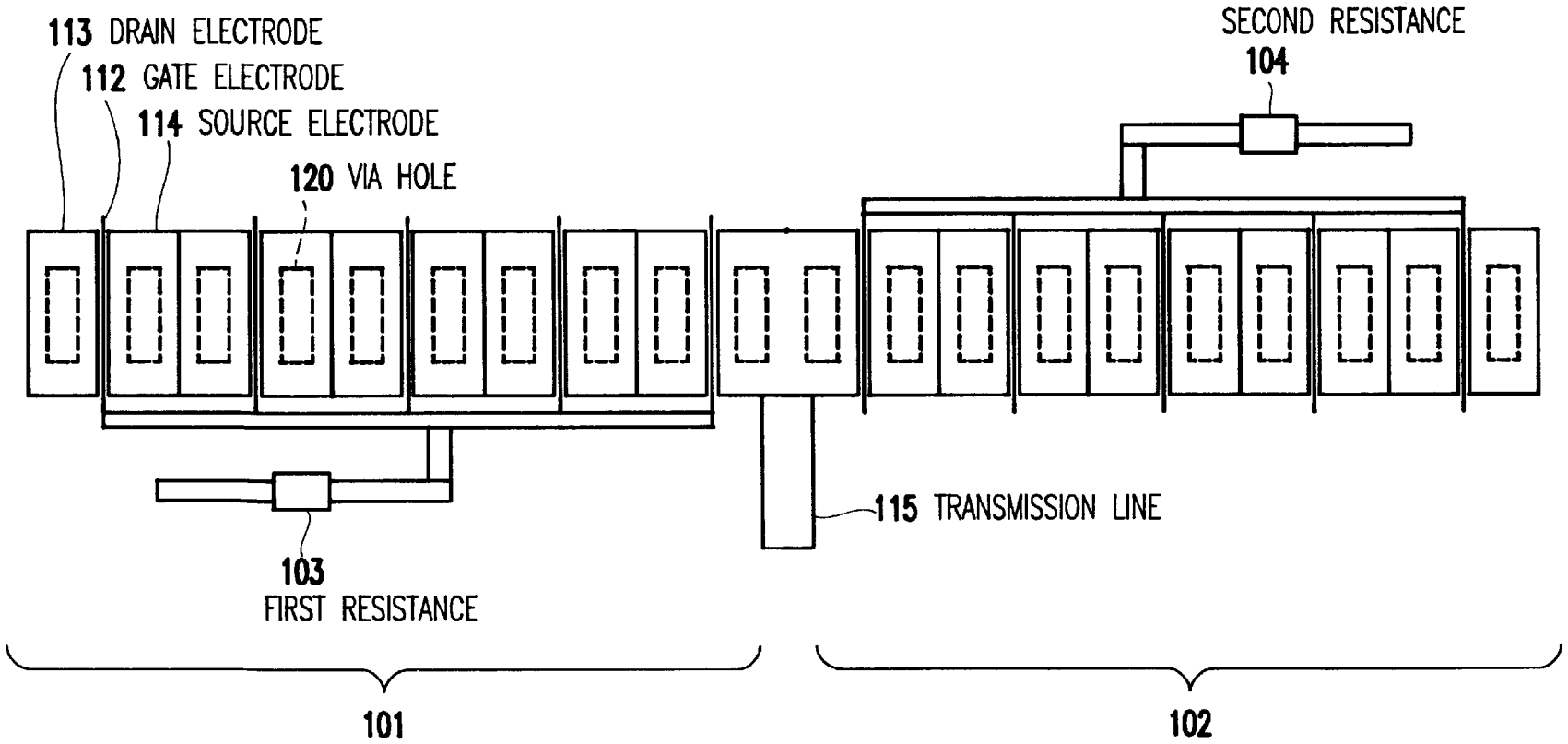
FIG. 31 is a plan view showing a semiconductor device in a seventh preferred embodiment according to the invention.

Referring to FIG. 31, a semiconductor device to form the switching circuit in the seventh embodiment will be explained below.

FIG. 31 is a plan view showing the semiconductor device in the seventh embodiment. The semiconductor device in this embodiment is composed of the same FETs as those in the sixth embodiment, Though the sixth embodiment uses the ten or five unit circuits connected in series, this embodiment uses five unit circuits connected in series.

As shown in FIG. 31, the semiconductor device is formed connecting in series the first switching circuit 101 and the second switching circuit 102. A transmission line 115 is connected to a connection point between the first switching circuit 101 and the second switching circuit 102 and is further connected to a first terminal (not shown) Also, one end (not connected with the second switching circuit 102) of the first switching circuit 101 is connected to a second terminal 106 (not shown), and one end (not connected with the first switching circuit 101) of the second switching circuit 102 is connected to a third terminal 107 (not shown).

Each FET is composed of a gate electrode 112, and a drain electrode 113 and a source electrode 114 disposed sandwiching the gate electrode 112. Meanwhile, the drain and source electrodes 113, 114 also serve as a transmission line.

Also, the drain and source electrodes 113, 114 of FET to also serve as a transmission line are connected through a via hole 120 to serve as an inductor to the back surface of a semiconductor substrate where ground metal is formed. Thus, a unit element is composed of FET including the transmission lines, and the via hole 120. The semiconductor device in the seventh embodiment is composed of five unit elements connected in series.

Also, the gate electrodes 112 of FETs in each of the switching circuits are commonly connected, In the first switching circuit 101, a bias voltage is equally applied through the first resistance 103. Similarly, in the second switching circuit 102, a bias voltage is equally applied through the second resistance 104.

Though, in this embodiment, the single-pole double-throw switching circuit is formed using the switching circuit and semiconductor device in the sixth embodiment, a similar switching circuit can be also formed by using any of the switching circuits and semiconductor devices in the first to fifth embodiments.

According to the switching circuit and semiconductor device in the above embodiments, an ON-state with low insertion loss when turning off FETs and an OFF-state with high isolation when turning on FETS can be obtained. Also, a wide effective band can be obtained, compared with the conventional switching circuit. For example, in a same frequency band, the wide effective band in the embodiments is about 2.6 times or more that in the conventional switching circuit. Thus, the high performance and wide effective hand in the switching circuit of the invention can be obtained even at a high frequency of more than 100 GHz.

Although the invention has been described with respect to specific embodiment for complete and clear disclosure, the appended claims are not to be thus limited but are to be construed as embodying all modification and alternative constructions that may be occurred to one skilled in the art which fairly fall within the basic teaching here is set forth.

What is claimed is:

1. A switching circuit, comprising:

a first unit circuit connected in series with a second unit circuit, each said unit circuit including two field-effect transistors connected in series and an inductor that has one end connected to a connection point between said two field-effect transistors and another end thereof grounded;

wherein gates of said two field-effect transistors are commonly connected and a bias voltage to control turning on/off of said two field-effect transistors is equally applied through a resistance to said respective gates.

2. A switching circuit, according to claim 1, wherein:

said inductor is a via hole formed through a semiconductor substrate.

3. A switching circuit, according to claim 1, further comprising:

a transmission line connected to at least one of the source or drain of one of said two field-effect transistors.

4. A plurality of switching circuits each switching circuit of said plurality of switching circuits comprising the switching circuit of claim 1, wherein respective ends of a side of each switching circuit of said plurality of switching circuits are commonly connected, and different bias voltages can be applied to said plurality of switching circuits.

5. A switching circuit, comprising:

a first unit circuit connected in series with a second unit circuit, said first unit circuit including a field-effect transistor, a first inductor that has one end connected to a source of said field-effect transistor and another end thereof grounded, and a second inductor that has one end thereof connected to a drain of said field-effect transistor and another end thereof grounded;

wherein a gate of said field effect transistor is connected to a gate of another field-effect transistor and a bias voltage to control turning on/off of said field-effect transistor is equally applied through a resistance to said respective gates.

6. A switching circuit, according to claim 5, wherein:

said inductor is a via hole passing through a semiconductor substrate.

7. A plurality of switching circuits each switching circuit of said plurality of switching circuits comprising the switching circuit of claim 5, wherein respective ends of a side of each switching circuit of said plurality of switching circuits are commonly connected, and different bias voltages can be applied to said plurality of switching circuits.

8. A switching circuit, comprising:

a first unit circuit connected in series with a second unit circuit, said first unit circuit including a field-effect transistor, first and second transmission lines connected in series to a source of said field-effect transistor, third and fourth transmission lines connected in series to a drain of said field-effect transistor, a first inductor that has one end thereof connected to a connection point between said first and second transmission lines and another end thereof grounded, and a second inductor that has one end thereof connected to a connection point between said third and fourth transmission lines and another end grounded;

wherein a gate of said field-effect transistor is connected to a gate of another field-effect transistor and a bias voltage to control turning on/off of said field-effect transistor is equally applied through a resistance to said respective gates.

9. A switching circuit, according to claim 8, wherein:

said inductor is a via hole passing through a semiconductor substrate.

10. A plurality of switching circuits, each switching circuit of said plurality of switching circuits comprising the switching circuit of claim 8, wherein respective ends of a side of each switching circuit of said plurality of switching circuits are commonly connected, and different bias voltages can be applied to said plurality of switching circuits.

11. A semiconductor device, comprising:

a first unit element connected in series with a second unit element, said first unit element including two field-effect transistors connected in series each of which has a source electrode and a drain electrode disposed sandwiching a gate electrode therebetween, one of said source electrode and said drain electrode being used as a connection electrode for the series connection of said transistors, and a via hole disposed on a semiconductor substrate to connect said connection electrode with a ground potential, said via hole operating as an inductor; and a resistance disposed on a gate bias line to apply a bias voltage to control turning on/off of said two field-effect transistors equally to a plurality of said gate electrodes;

wherein said plurality of said gate electrodes are commonly connected.

12. A semiconductor device, according to claim 11, wherein:

said via hole and said connection electrode are connected through a transmission line.

13. A semiconductor device, comprising:

a first unit element connected in series with a second unit element said first unit element including a field-effect transistor which has a source electrode and a drain electrode disposed sandwiching a gate electrode therebetween, a first via hole disposed through a semiconductor substrate to connect said source electrode with a ground potential, and a second via hole disposed on said semiconductor substrate to connect said drain electrode with said ground potential, said first and second via hole operating as inductors; and a resistance disposed on a gate bias line to apply a bias voltage to control turning on/off of said field-effect transistor equally to said gate electrode that is commonly connected to a gate electrode of another field-effect transistor.

14. A semiconductor device, comprising:

a first unit element connected in series with a second unit element, said first unit element including a field-effect transistor which has a source electrode provided with the function of first and second transmission lines and a drain electrode provided with the-function of third and fourth transmission lines are disposed sandwiching a gate electrode therebetween, a first via hole disposed through a semiconductor substrate to connect a connection point between said first and second transmission lines with a ground potential, and a second via hole disposed on said semiconductor substrate to connect a connection point between said third and fourth transmission lines with said ground potential, said first and second via hole operating as inductors; and a resistance disposed on a gate bias line to apply a bias voltage to control the turning on/off of said field-effect transistor equally to said gate electrode that is commonly connected to a gate electrode of a field effect transistor of said second unit element.

15. A switching circuit, comprising:

at least two unit circuits connected in series, each of said at least two unit circuits including two field-effect transistors connected in series, and an inductor having one end connected to a connection point between said two field-effect transistors and another end thereof grounded, wherein gates of said two field-effect transistors in said each of said at least two unit circuits are connected via a common resistance to a bias voltage-applying terminal, whereby said two field-effect transistors in said each of said at least two unit circuits are turned on and off in accordance with a bias voltage applied to said bias voltage-applying terminal.

* * * * *